United States Patent [19]

Kupersmit

[11] Patent Number: 4,549,673

[45] Date of Patent: Oct. 29, 1985

[54] COLLAPSIBLE CONTAINER FOR LIQUIDS

[76] Inventor: Julius B. Kupersmit, 299 W. 12th St., New York, N.Y. 10011

[21] Appl. No.: 674,940

[22] Filed: Nov. 26, 1984

[51] Int. Cl.[4] ..... B67B 7/24

[52] U.S. Cl. ..... 220/465; 220/85 B; 222/83; 222/89; 222/105; 222/183; 229/23 AB

[58] Field of Search ..... 220/465, 258, 403, 470, 220/83, 85 B; 229/7 R, 17 R, 37 R, 23 AB, DIG. 3; 222/83, 89, 91, 105, 183

[56] References Cited

U.S. PATENT DOCUMENTS

| | | | |
|---|---|---|---|
| 2,430,901 | 11/1947 | Bradley | 150/55 |
| 2,981,443 | 4/1961 | Baldwin | 222/183 |
| 3,201,111 | 8/1965 | Afton | 220/85 B |
| 3,239,104 | 3/1966 | Scholle | 222/89 X |
| 3,349,965 | 10/1967 | Krugger | 222/105 X |
| 3,503,550 | 3/1970 | Main et al. | 229/23 AB |
| 4,349,133 | 9/1982 | Christine | 222/183 |
| 4,440,316 | 4/1984 | Christine | 222/183 X |
| 4,475,670 | 10/1984 | Rutter | 222/83 |

FOREIGN PATENT DOCUMENTS

| | | | |
|---|---|---|---|
| 1102794 | 3/1961 | Fed. Rep. of Germany | 220/22 |

*Primary Examiner*—Steven M. Pollard
*Attorney, Agent, or Firm*—Charles E. Temko

[57] ABSTRACT

A collapsible container for fluid materials such as liquids, slurrys, fine particulates and the like. The device includes a foldable box-like outer container and a blow molded synthetic resinous inner element in the form of a bottle which may be collapsed when empty and returned to a shipper with the outer container for reuse. The bottle is provided with a molded fitment adjacent to a lower edge of a side wall to which a dispensing valve may be fitted. In an another embodiment, the valve includes a corresponding fitment with a noncircular periphery which engages a liner element forming part of the container, in nonrotational relation, so that the dispensing valve may be conveniently threadedly attached thereto, without the use of tools. A third embodiment employs a nonreusable synthetic resinous bag as an inner element, and the dispensing valves includes a cutting edge which penetrates the bag upon installation.

4 Claims, 11 Drawing Figures

DETAILED DESCRIPTION OF THE DISCLOSED EMBODIMENT

Figure 1:
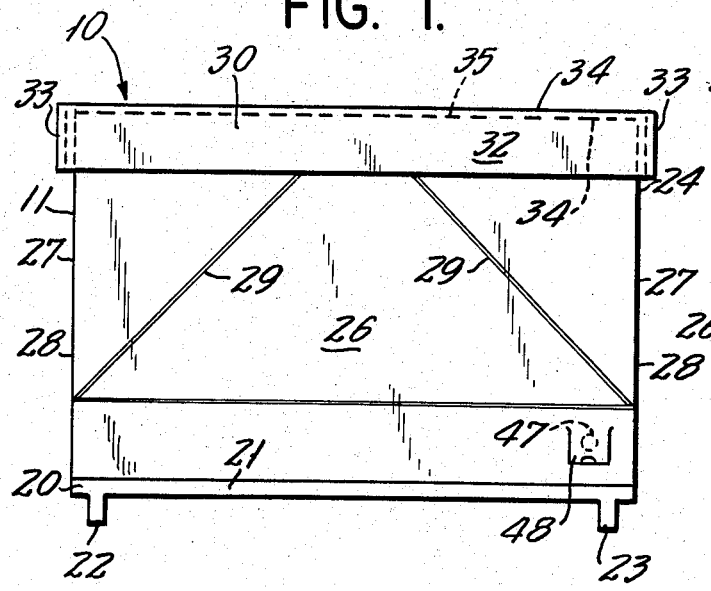

In accordance with the first embodiment of the invention, the device, generally indicated by reference character 10, comprises broadly: an outer collapsible container element 11 and a collapsible bottle element 12.

The container element 11 is of generally conventional and known construction, and may be permanently positioned upon a pallet 20 or equivalent having a horizontal floor 21 and skids 22 and 23 permiting the entry of a fork lift (not shown) therebetween. The cardboard container body 24 includes a flap type bottom wall 25, a pair of side walls 26, and a pair of end walls 27 interconnected at vertically extending corners 28. As is known in the art, the side walls 27 may be provided with score lines 29 for folding the same to planar condition.

A lid member 30 is also conventional, and includes an upper horizontal wall 31, a pair of long side walls 32, and a pair of short side walls 33 defining an upper continuous edge 34 adapted to overlie the continuous upper edge 35 of the body 24.

The bottle element 12 is formed by blow molding from a flexible non-porous synthetic resinous material, such as polyethylene or polystyrene. In inflated condition it is of rectangular configuration conforming to the void formed by the walls 26 and 27 of the element 11. It thus includes a lower wall 41, an upper wall 42, side walls 43 and end walls 44. Disposed within the upper wall 42 is an integrally molded upper opening 45 selectively closed by a closure 46. A similar opening 47 may be fitted with a drain cock (not shown) or provision for the same. A flap opening 48 is provided in one of the walls 26 to provide access to the opening 47 to permit the device to be drained in selective fashion.

Figure 3:
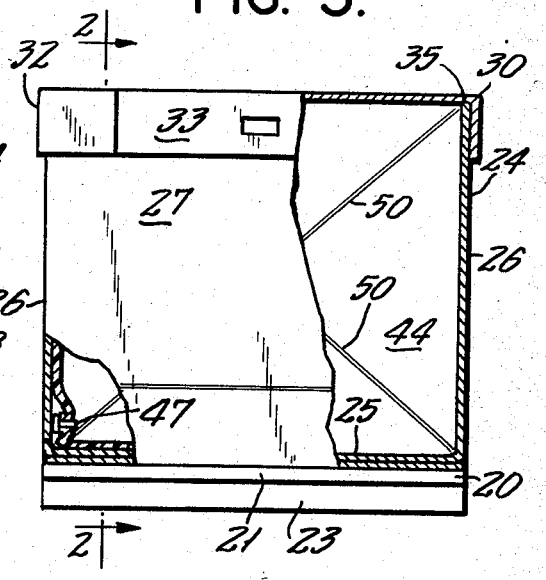
Figure 2:
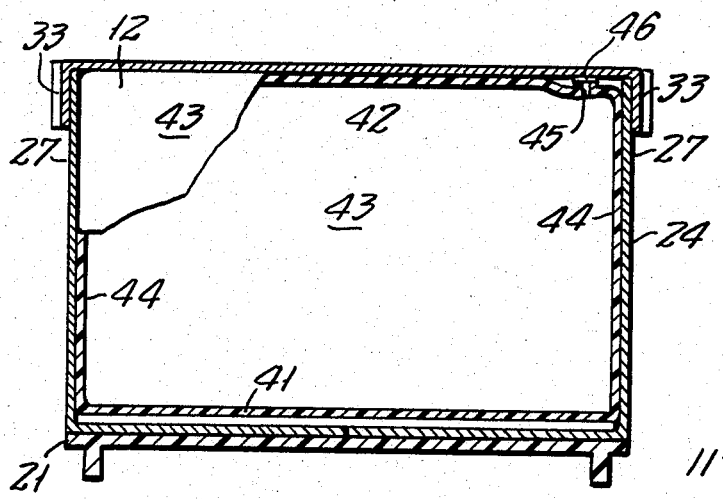
Figure 4:
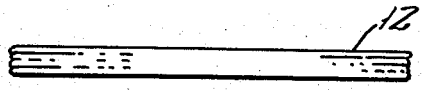
Figure 5:
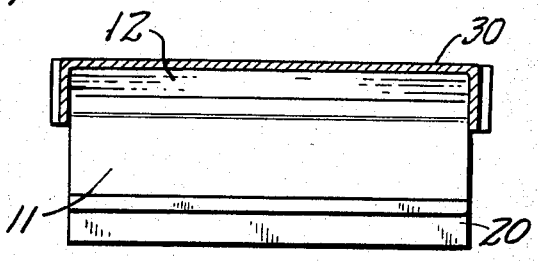

In the embodiment shown in FIGS. 3 and 4, the end walls 44 are provided with fold lines 50 to permit the element 12 to be folded to planar condition as shown in FIG. 4 when not in use. In this condition, it may be placed on top of the collapsed walls 26 and 27 of the element 11 to be subsequently covered and protected by the lid member 30 for return shipment of the device, as is known in the art.

Figure 6:
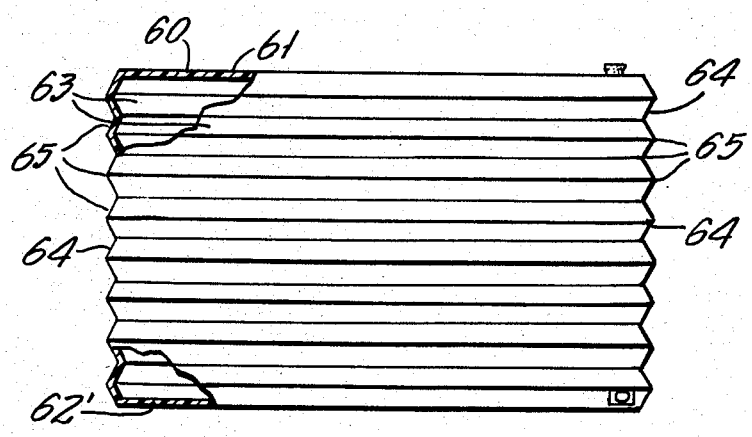
Figure 7:
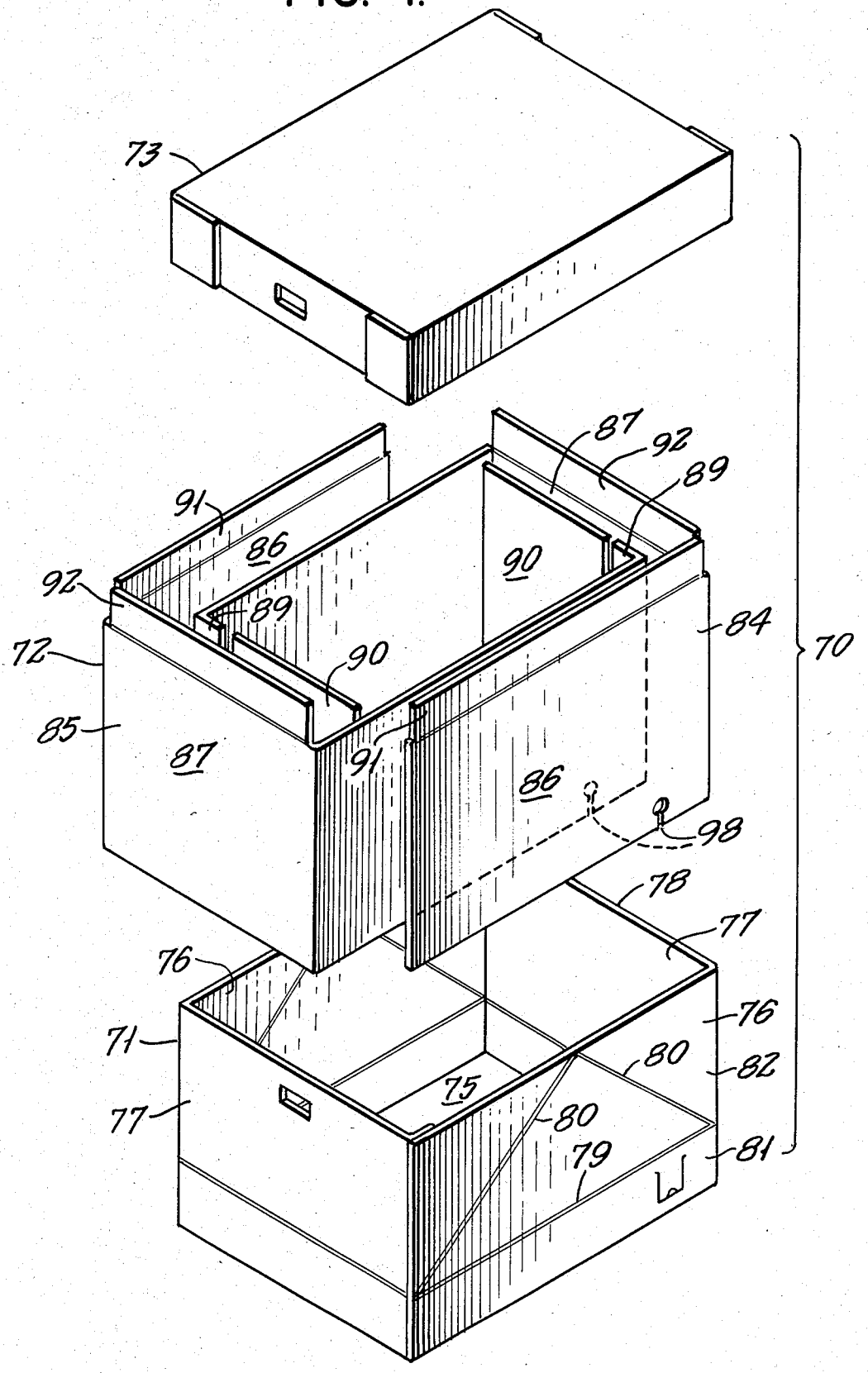
Figure 8:
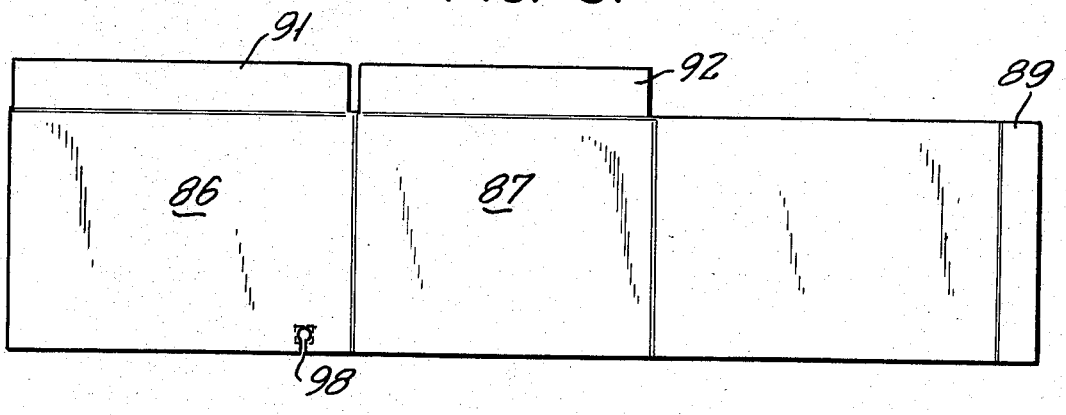

In the alternate form of bottle element 12 shown in FIG. 6, the fold lines 50 are replaced by the provision of side walls which are formed in accordion fashion to permit collapse along a vertical axis without the necessity of folding. Thus, the bottle element 60 includes an upper wall 61, a lower wall 62, side walls 63 and end air hose into the opening 45, with the drain opening closed, an operation which permits the side and end walls 43 and 44 to be moved to congruent relation with respect to the corresponding walls 32 and 33. The opening 45 may then be stoppered until the liquid contents are ready for introduction, and during loading, the load will displace the air previously injected and thus maintain the bottle element in erected condition as loading proceeds.

Once loaded, the upper opening 45 is again stoppered and the lid member 30 placed on the body 24 to be secured in position, and sealed, if required.

Upon arriving at its designation, the container may be moved to a suitable horizontal supporting surface (not shown) for draining, and once emptied, the bottle element 12 may be removed from the container element for manually folding the same to relatively planar condition. This may be best accomplished with both the filler and drain opening left opened, so that air entrapped therein my be readily vented.

The element 10 is ready for return shipment by placing the collapsed bottle element 12 upon the folded walls of the container element 11, so that the lid member 30 may by then employed as a cover to protect both elements. In this condition, the device 10 is normally only an inch or two thicker than the container element itself, and multiple devices may be stacked for either storage or shipment without difficulty.

Turning now to the second embodiment of the invention, illustrated in FIGS. 7–10, inclusive, the device, generally indicated by reference character 70 includes a main body element 71, an insert element 72, a lid element 73 and a bottle element 74.

The main body element 71 is of known type, including a bottom wall 75 which may be supported by a pallet (not shown), a pair of side walls 76, and a pair of end walls 77 forming a continuous upper edge 78. A continuous horizontal score line 79 defines that portion of the lower part of the element 71 which does not fold when the element is collapsed. Angular score lines 80 extend above the noncollapsible lower part 81 only over the collapsible upper part 82. As this type of collapsible container is known in the art, it need not be further considered in detail in the present disclosure.

The insert element 72 is also collapsible, and is most conveniently formed to include first and second members 84 and 85 which are substantially similar. Each member includes an outer side wall 86, and an outer end wall 87, an inner side wall and an inner end wall 89. To facilitate folding, the walls 89 are relatively narrow, and a separate insert panel 90 is provided at each end. Top flaps 91 & 92 overlie the upper surface of the bottom wall of the main body element 71.

Figure 9:
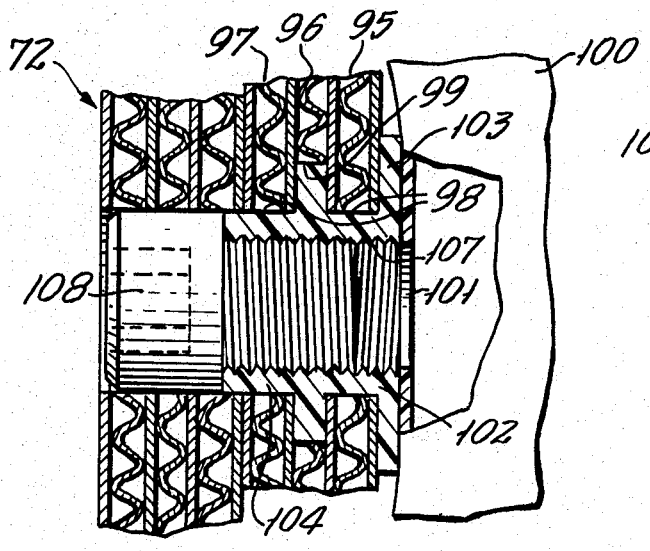
FIG. 9 is a fragmentary enlarged sectional view on an integrally molded fitment in engaged condition with the insert element shown in FIG. 8.

Referring to FIG. 9 in the drawing, the insert element 72 is formed of triple ply corrugated board, to include through opening 107 is provided with a temporary plug 108 during filling and shipment.

Figure 10:
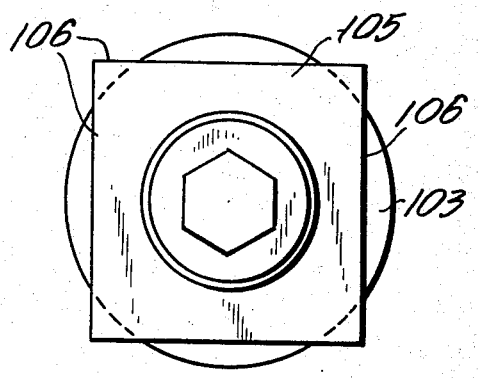
FIG. 10 is a side elevational view of the fitment shown in FIG. 9.
Figure 11:
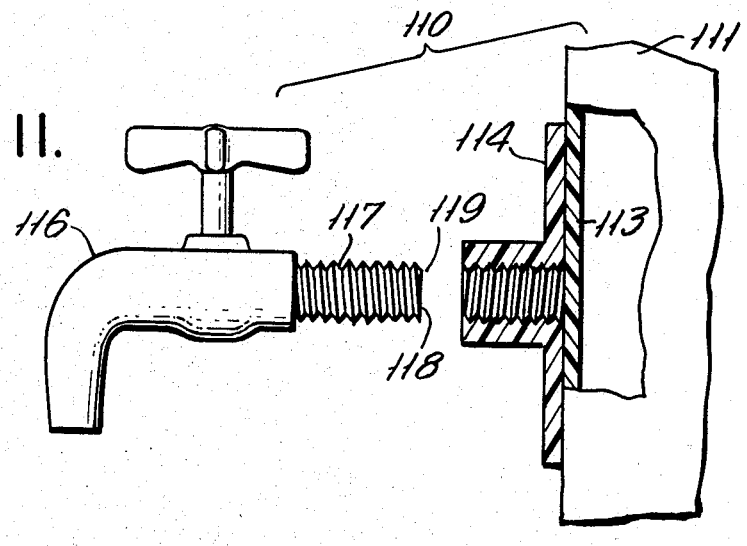
FIG. 11 is a schematic sectional view showing a third embodiment of the invention.
Figure 7:
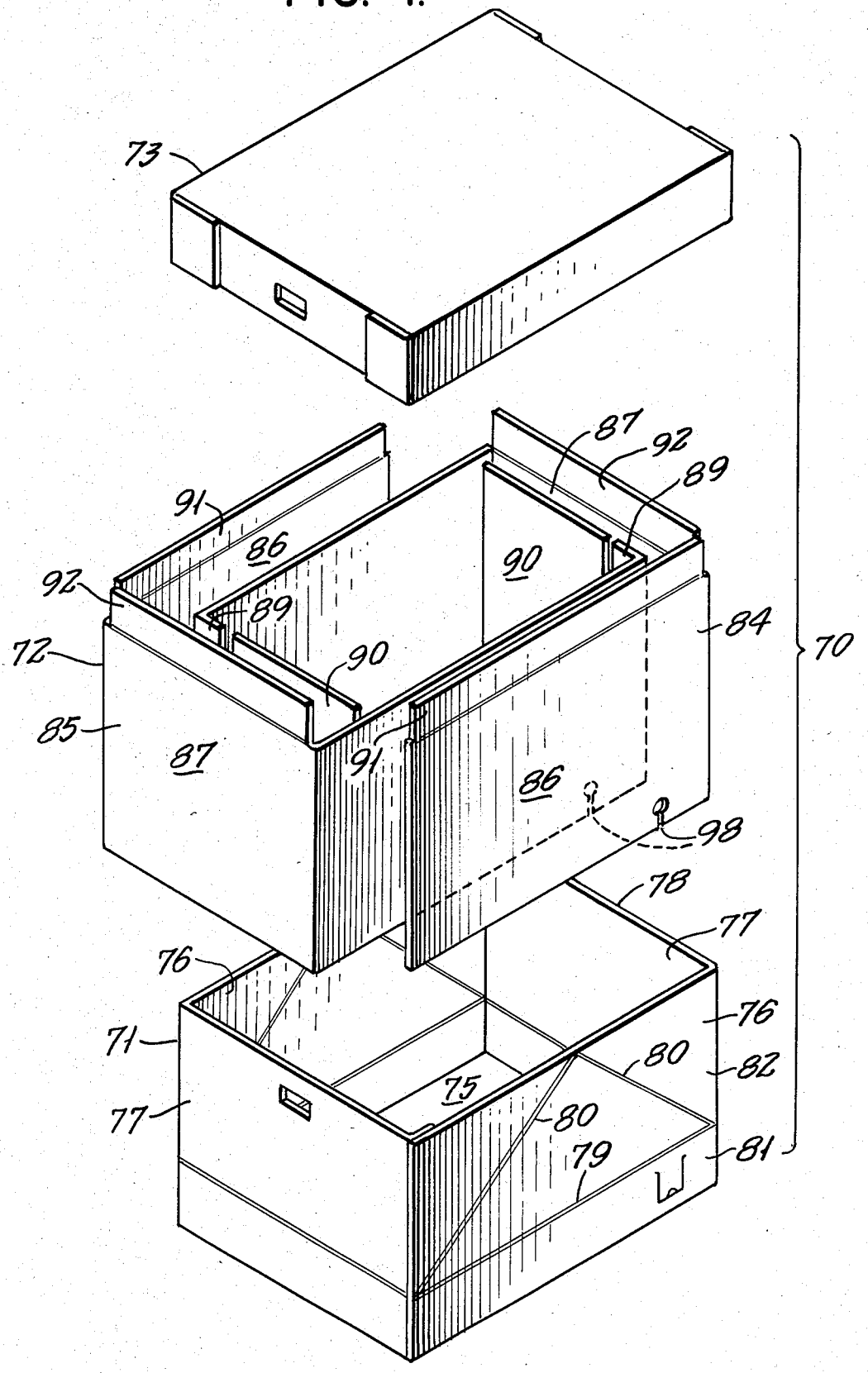

Referring to FIG. 10, it will be observed that the rectangular configuration of the outer flange 105 corresponds to the square slot 99, so that when the bottle element 100 is positioned within an erected container, the flange 105 may be prevented from rotating relative to the slot 99, thereby permitting the removal of the plug 108 and installation of a threaded draincock from the exterior of the container as a manual operation, without the use of tools.

Turning now to the third embodiment, generally indicated by reference character 110, in this embodiment, the bottle element of the first and second embodiments is substituted by a thin synthetic resinous bag 111, a lower portion 113 of a side wall being provided with a fixture 114 similar to that in the second embodiment.

A plug corresponding to the plug 108 of the second embodiment is not employed. Instead, a draincock 116 is provided with a threaded shank 117 having an inner end 118 provided with an angularly disposed edge 119, which, when rotated as it engages the fixture, 114 cuts an opening through the wall 113 to provide communication with the contents.

I wish it to be understood that I do not consider the invention limited to the precise details of structure shown and set forth in this specification, for obvious modifications will occur to those skilled in the art to which the invention pertains.

I claim:

1. An improved collapsible shipping container comprising: a collapsible outer container element and a collapsible impermeable liquid-proof inner bottle element; said outer container element including a main body having a lower wall, a plurality of foldably interconnected side walls extending therefrom to define an upwardly facing opening to a rectangularly-shaped void, and a cover member including a planar wall selectively overlying said opening; said bottle element being molded integrally of a flexible synthetic resinous material to include a bottom wall, a plurality of opposed side and end walls, and an upper wall and being of dimensions and configuration corresponding to the void formed by said main body element; said bottle element having a sealable inlet opening in the area of said upper wall and a sealable drain opening in the area of said lower wall; at least some of the walls of said bottle element having elongated areas of relatively thin cross sections to permit folding thereon for the purpose of collapsing said bottle element when empty to substantially planar condition; whereby, upon readying said outer container for use, said outer container element is placed in erected condition to form said void and said bottle element is placed therein to be inflated in situ to substantially fill said void prior to loading; said bottle element, when subsequently empty being collapsible to relatively planar condition.

2. A collapsible shipping container in accordance with claim 1, further characterized in said outer container element being formed of fibrous material, and said bottle element is blow molded from synthetic resinous material.

3. An improved collapsible shipping container comprising: a collapsible outer container element including a main body having a lower wall, a plurality of foldably interconnected side walls extending therefrom to define an outwardly facing opening to a rectangularly-shaped void, and a cover member including a planar wall selectively overlying said opening; a liquid-impermeable bag element of flexible sythetic resinous material including a bottom wall and opposed side and end walls and being of dimensions in expanded configuration generally corresponding to the void formed by said main body elements; said outer container element having an opening in a lower portion of a side wall thereof for the draining of the contents of said bag therethrough; said container element having a rectangularly shaped liner having side and end walls, at least one of which are formed from three plies of material, and having a recess of non-circular configuration extending through a medially disposed ply; and a generally tubular fitment having an axially disposed through opening, and having an inner flange sealed to an outer surface of said bag, and an outer flange of non-circular configuration selectively positioned within said recess in said liner element in non-rotatable relation, and fixed axially between the outer plies of said three plies of material.

4. A collapsible shipping container for use in shipping liquids comprising: an outer container element of fibrous material having a bottom wall, and at least one side wall having a selectively closable opening therethrough in an area adjacent said bottom wall; a planar liner element disposed within said outer container element and defining a non-circular opening aligned with said opening in said outer container element; a collapsible liquid-impermeable inner container positioned inwardly of said liner element and having a side wall having an area aligned with said openings in said outer container and liner elements; and a fitment of tubular configuration having an inner end in sealed relation relative to an outer surface of said last-mentioned side wall, and an outer end of non-circular configuration selectively engageable with said non-circular opening in said liner element in non-rotatable relation, said fitment having an axially oriented bore therein; said liner element being of three ply laminated construction and having a medially disposed lamina having a non-circular through opening corresponding in configuration to said outer flange of said fitment, said non-medially disposed laminae having aligned openings of smaller configuration to prevent axially shifting of said outer flange of said fitment relative to said liner element.

* * * * *